US007210316B1

(12) United States Patent
Falconer et al.

(10) Patent No.: US 7,210,316 B1
(45) Date of Patent: May 1, 2007

(54) DOOR LOCK FOR TRAILERS AND CARGO CONTAINERS

(75) Inventors: Robert P. Falconer, Fort Worth, TX (US); Jewel B. Smith, Fort Worth, TX (US)

(73) Assignee: Blaylock Industries, Inc., Fort Worth, TX (US)

( * ) Notice: Subject to any disclaimer, the term of this patent is extended or adjusted under 35 U.S.C. 154(b) by 0 days.

(21) Appl. No.: 11/353,484

(22) Filed: Feb. 14, 2006

(51) Int. Cl.
*E05B 65/48* (2006.01)

(52) U.S. Cl. ..... 70/2; 70/32; 70/56; 70/211; 292/218; 292/DIG. 32

(58) Field of Classification Search ..... 70/2, 70/32–34, 54–56, 211, 212, 417, DIG. 43, 70/DIG. 56; 292/327, 218, 282, 285, 286, 292/DIG. 32
See application file for complete search history.

(56) References Cited

U.S. PATENT DOCUMENTS

| | | | | | |
|---|---|---|---|---|---|
| 2,662,389 | A * | 12/1953 | McKitrick | 70/174 |
| 3,996,774 | A * | 12/1976 | Best | 70/32 |
| 4,229,955 | A * | 10/1980 | Coralli et al. | 70/32 |
| 4,512,165 | A * | 4/1985 | Uyeda | 70/32 |
| 4,565,078 | A * | 1/1986 | Solomon | 70/95 |
| 4,567,740 | A * | 2/1986 | Kelly | 70/55 |
| 4,640,109 | A * | 2/1987 | Schaublin et al. | 70/202 |
| 5,118,149 | A * | 6/1992 | Emmons | 292/327 |
| 5,168,258 | A * | 12/1992 | Radke | 340/542 |
| 5,743,118 | A * | 4/1998 | Anderson | 70/56 |
| 5,975,595 | A * | 11/1999 | Lorenzo | 292/205 |
| 6,010,166 | A * | 1/2000 | Hamilton et al. | 292/282 |
| 6,233,984 | B1 | 5/2001 | Blehi, III | |
| 6,357,266 | B1 | 3/2002 | Van Buren | |
| 6,367,292 | B1 * | 4/2002 | Bunger | 70/56 |
| 6,463,769 | B1 * | 10/2002 | Garner | 70/56 |
| 6,464,269 | B1 * | 10/2002 | Wilhelm et al. | 292/307 R |
| 6,519,982 | B1 * | 2/2003 | Brammall et al. | 70/56 |
| 6,622,533 | B1 * | 9/2003 | Santini | 70/56 |
| 6,708,532 | B2 * | 3/2004 | Winland | 70/2 |
| 6,766,671 | B2 * | 7/2004 | Haczynski et al. | 70/23 |
| 6,928,843 | B1 * | 8/2005 | Pirnie | 70/54 |
| 7,073,357 | B2 * | 7/2006 | Nixon, Jr. | 70/56 |
| 2004/0221626 | A1 | 11/2004 | Palzkill, et al. | |
| 2005/0144991 | A1 | 7/2005 | Bravo, et al. | |

OTHER PUBLICATIONS

U.S. Appl. No. 29/230,383, filed May 5, 2005, Falconer, et al.

* cited by examiner

*Primary Examiner*—Suzanne Dino Barrett
(74) *Attorney, Agent, or Firm*—Bracewell & Giuliani LLP

(57) ABSTRACT

A lock assembly for a hinged door has a pair of hasps that align with each other, each having a hole. A housing with an open back fits over the hasps. A retainer pin extends through an aperture in the housing and through the aligned holes of the hasps. The retainer pin has a pair of axially spaced apart shoulders. A key actuated lock member has a lock pin that extends perpendicular to the retainer pin and between the shoulders in an engaged position.

18 Claims, 2 Drawing Sheets

55
53
47
43
11
46
35
33
19
29
41
65
57
21
61
59
63
31
27
17
25
32
49
37
51
23
42

DOOR LOCK FOR TRAILERS AND CARGO CONTAINERS

FIELD OF THE INVENTION

This invention relates in general to lock assemblies for locking hinged doors such as on trailers and cargo containers.

BACKGROUND OF THE INVENTION

Many trailers and cargo containers have hinged doors. One type of door lock assembly comprises a shaft or rod that extends on the exterior of the door past opposite edges of the door. The shaft may be oriented vertically or horizontally, and has ends that engage brackets mounted adjacent to the door. When the shaft is rotated in one direction, it can be disengaged from the brackets to allow the door to be opened. A handle is pivotally mounted to the shaft for causing the rotation. The handle extends past an edge of the door and engages a pair of hasps. One of the hasps is fixed while the other is pivotal. Both hasps have holes that register when aligned. The hasps are contoured to define a closed channel or passage for the handle. Typically, a padlock is inserted through the mating holes of the hasps.

Padlocks are relatively easy to break or cut. Once the padlock is broken, the door can be readily opened. Devices have been proposed that purport to be more resistant to tampering than a padlock. Some of the devices include a cover that fits over the hasps. A key-actuated lock member is mounted to the housing and has a lock pin that strokes in response to rotation of the key. The lock pin is configured to extend through mating holes of the hasps.

SUMMARY OF THE INVENTION

In this invention, the lock assembly has a housing with an open back for placing the housing over the hasp and against the door. A retainer pin extends through an aperture in the housing. The retainer pin is movable relative to the housing along an axis of the pin for passing through a hole in the hasp. The retainer pin has a pair of axially spaced apart shoulders on it.

A key actuated lock member is mounted to the housing. The lock member has a lock pin that extends within the housing into engagement with the retainer pin between the shoulders in response to rotation of the lock member. This engagement prevents removal of the retainer pin from the hasp while locked.

DETAILED DESCRIPTION OF THE INVENTION

Figure 1:
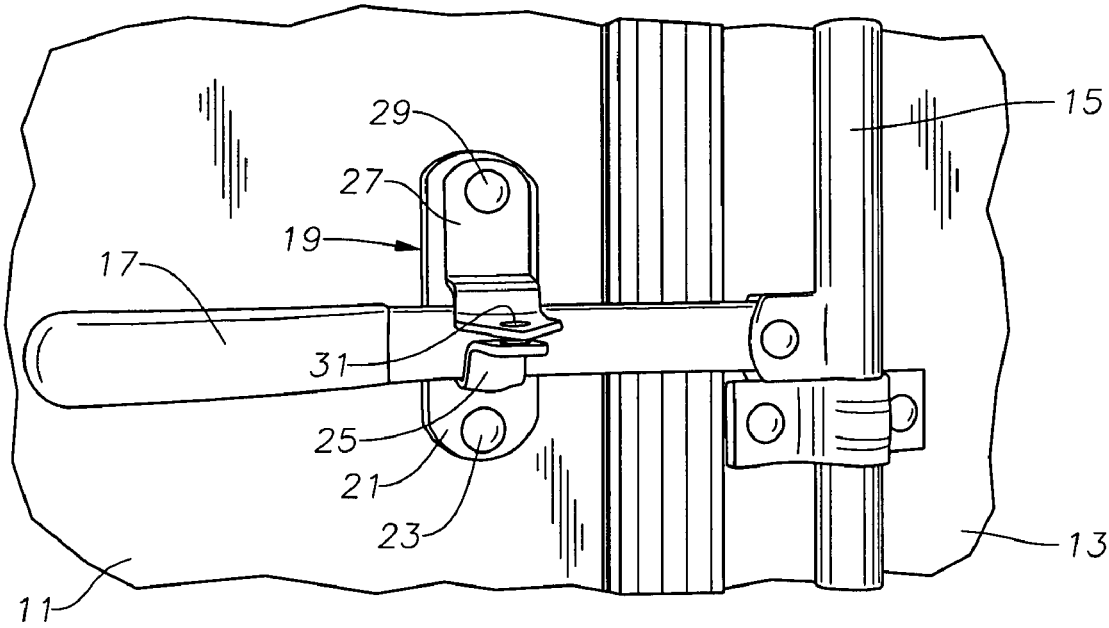
Fig. 1 (Prior Art)
FIG. 1 is a perspective view of a portion of a prior art door lock.

Referring to FIG. 1, the door lock assembly shown is a type for securing two hinged doors 11, 13 of a trailer or cargo container. A rod or shaft 15 extends vertically past the upper and lower edges of door 13. In some applications, shaft 15 extends horizontally. Shaft 15 has end portions that engage locking brackets or keepers(not shown) mounted to the trailer adjacent door 11 when rotated to the position shown in FIG. 1. A handle 17 is pivotally mounted to shaft 15 for rotating shaft 15 from a locked and unlocked position. Handle 17 extends past door 13 over to door 11 while in the locked position and engages a hasp assembly 19.

Hasp assembly 19 typically has a mounting plate 21 that is secured to the door. A lower fastener 23 secures the lower portion of mounting plate 21 to door 11. A fixed hasp 25 is welded to mounting plate 21. A pivotal hasp 27 is pivotally mounted to mounting plate 21 by a fastener 29. Fastener 29 extends through mounting plate 19 and pivotally secures the upper portion of mounting plate 19 to door 11. Each hasp 25, 27 has a hole 31, the holes 31 aligning with each other while in the position shown in FIG. 1. Hasps 25, 27 are configured to define a closed channel 32 while in the locked position shown in FIG. 3. Closed channel 32 retains handle 17 to prevent movement of handle 17. Swinging pivotal hasp 27 out of the way allows handle 17 to be lifted from fixed hasp 25. Rotating handle 17 outward from door 11 releases shaft 15 from the keepers at the lower and upper edges of door 11.

Figure 2:
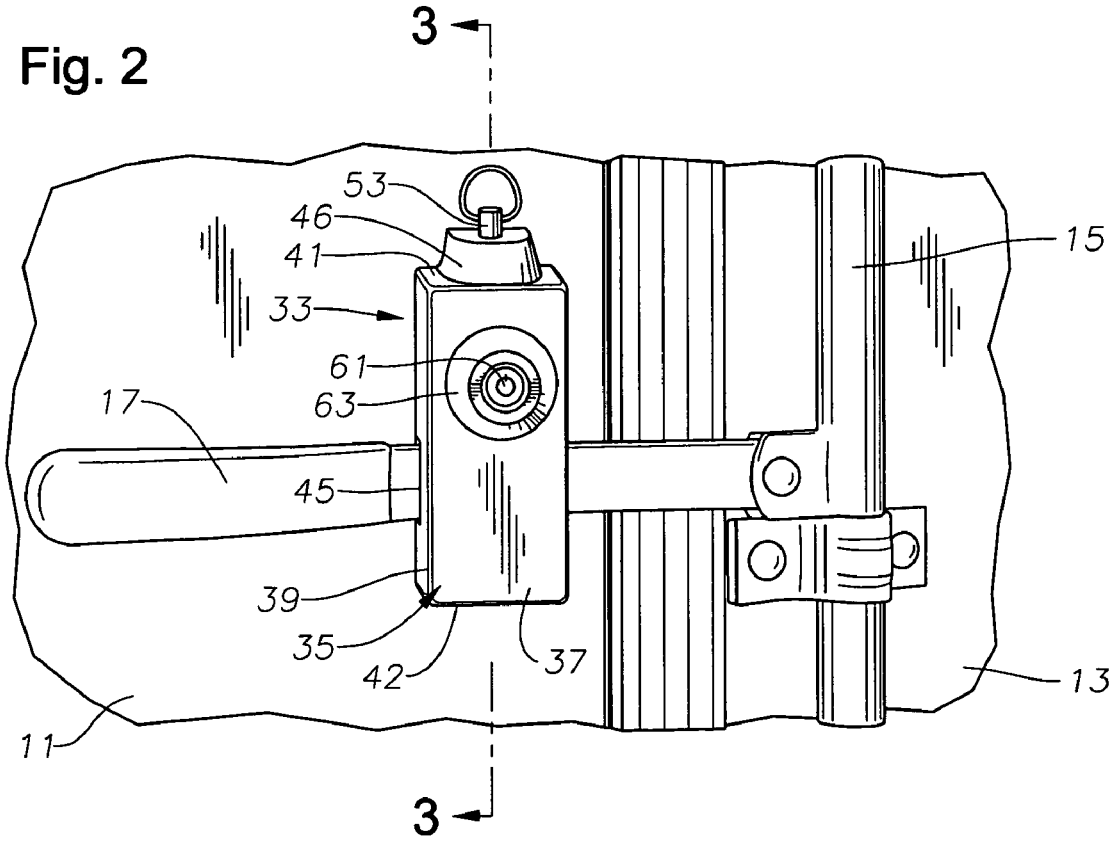
FIG. 2 is a perspective view of a lock assembly in accordance with this invention incorporated with the door lock of FIG. 1.
Figure 3:
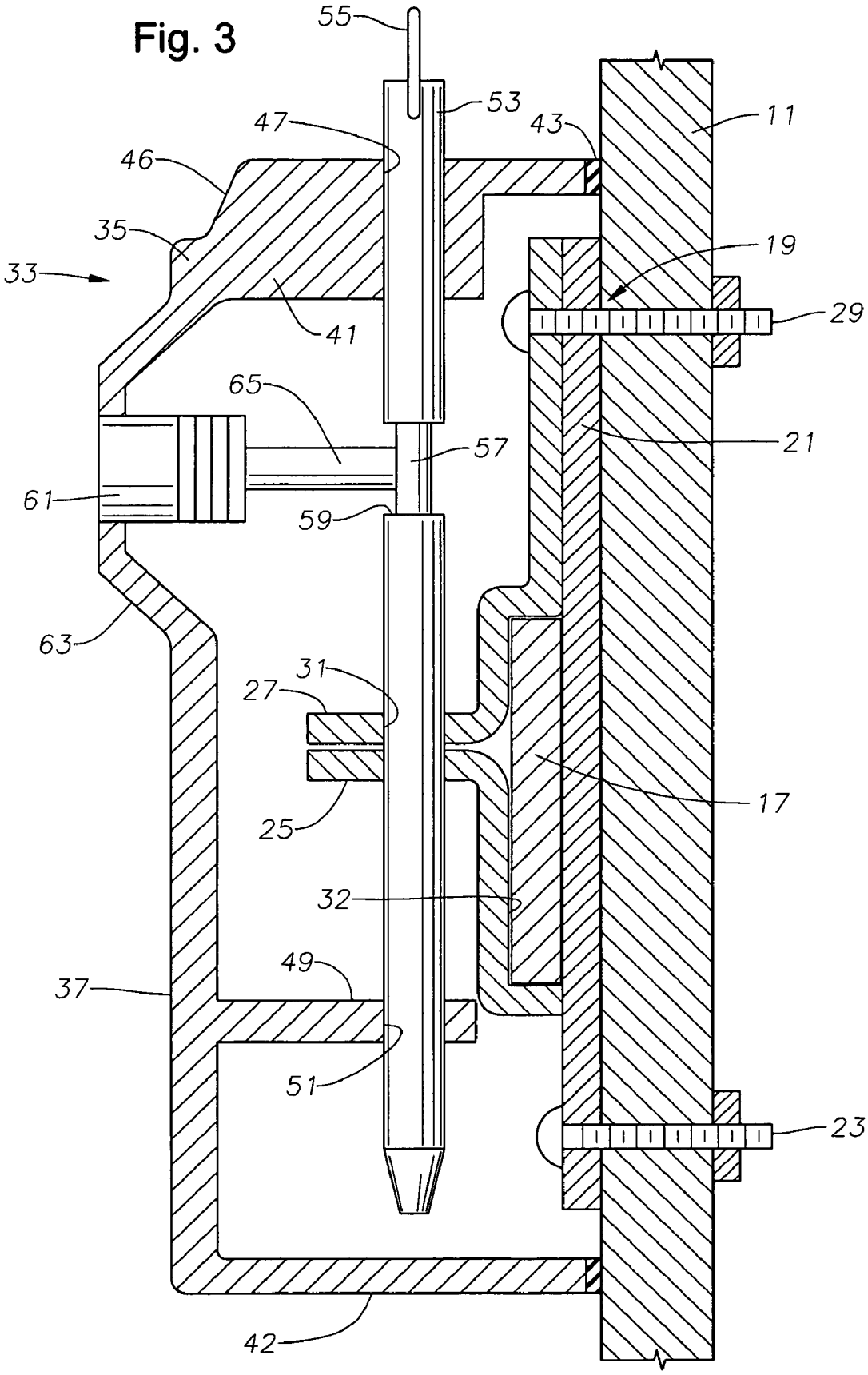
FIG. 3 is an enlarged sectional view of the lock assembly of FIG. 2, taken along the line 3—3 of FIG. 2.

Referring to FIG. 2, a lock assembly 33 for locking handle 17 within hasps 25, 27 includes a housing 35 that fits over the entire hasp assembly 19. Housing 35 fits over mounting plate 21 as well as fasteners 23, 29 and hasps 25, 27. In this embodiment, housing 35 is generally rectangular, having a greater length than its height. However the length could be less than the height, and housing 35 could be shapes other than rectangular, such as cylindrical. Housing 35 has a front wall 37 that has a substantially flat portion in a plane parallel to the plane containing door 11. Housing 35 has two sidewalls 39 in this embodiment that extend from opposite side edges of front wall 37 toward door 11. Housing 35 has two end walls 41, 42 that are substantially parallel to each other and perpendicular to sidewalls 39. As shown in FIG. 3, housing 35 has an open back for placement over hasp assembly 19. Preferably a gasket 43 is bonded to the free edges of end walls 41, 42 and sidewalls 39 for preventing marring of the finish of door 11 when in contact. As shown in FIG. 2, each sidewall 39 has a rectangular recess 45 on its free edge that is sized to accommodate handle 17. The distance between end walls 41, 42 at the free edges is greater than the length of mounting plate 21.

As shown in FIGS. 2 and 3, upper end wall 41 has an enlarged thickness portion or boss 46. An aperture 47 extends through boss 46. A bulkhead 49 is formed within the interior of housing 35 in a plane parallel to the plane containing lower end wall 42. Bulkhead 49 is spaced above lower end wall 42 a selected distance and has an aperture 51 that aligns with aperture 47.

A retainer pin 53 extends through aperture 47, hasp holes 31 and bulkhead aperture 51. The lower end of retainer pin 53 is recessed within housing 35 between bulkhead 49 and lower end wall 42 while in the locked position of FIG. 3. Retainer pin 53 can be moved upward completely out of registry with apertures 47 and 51. A loop or bail 55 on the upper end of retainer pin 53 limits the downward travel of retainer pin 53 within housing 35. Retainer pin 53 is preferably cylindrical and has a reduced diameter section 57 that is also cylindrical but of a smaller diameter. Reduced diameter section 57 defines two opposed shoulders 59 that are in planes perpendicular to the axis of retainer pin 53.

A key actuated lock 61 is mounted to a protruding boss 63 formed in front wall 37. Lock 61 is of a conventional type that operates with a key and has a pin or bolt 65 that extends and retracts when actuated by the key. Lock pin 65 has a length selected so that its free end will pass into reduced diameter section 57, although it need not touch reduced diameter section 57. Lock pin 65 protrudes further inward than shoulders 59 so that if one pulls upward on retainer pin 53 while lock pin 65 is extended, lower shoulder 59 will contact lock pin 65 and prevent the removal of retainer pin 53. Pushing down on the upper end of retainer pin 53 would cause lock pin 65 to contact the upper shoulder 59. While some axial movement can occur, the engagement of lock pin 65 with the reduced diameter section 57 limits the movement to a small amount. Lock pin 65 is shorter than retainer pin 53 in this embodiment.

In operation, the user closes the door conventionally and rotates shaft 15 to the closed position with handle 17. The user pivots pivotal hasp 27 upward and drops handle 17 into the receptacle formed by fixed hasp 25. The user then releases pivotal hasp 27, which causes the holes 31 to align. The user then pulls retainer pin 53 upward sufficiently so that it will clear hasps 25, 27. Alternately, the user may completely remove retainer pin 53. The user places housing 35 over hasp assembly 19 as shown in FIG. 3. The user then inserts retainer pin 53 through the aligned holes 31 and through hole 51 in bulkhead 49. The user then uses the key (not shown) to rotate lock 61, causing lock pin 65 to extend out to the extended position into proximity with reduced diameter portion 57. The user then removes the key.

The invention has significant advantages. The housing fits entirely over the hasp assembly including the mounting plate. Enclosing the entire hasp assembly prevents an intruder from trying to shear off the fasteners of the hasp mounting plate for the hasp. The housing is preferably formed of a strong material, such as cast aluminum, so as to resist breaking due to blows deliver by an intruder. The retainer pin protrudes only a short distance from the upper end does not protrude at all from the opposite end, so as to resist efforts by an intruder to remove the retainer pin.

While the invention has been shown in only one of its forms, it should be apparent to those skilled in the art that it is susceptible to various changes without departing from the scope of the invention. For example the retainer pin could be configured other than as a cylindrical rod. The opposed shoulders could be defined by a circular hole in the retainer pin rather than a reduced diameter cylindrical section. A single shoulder on the retainer pin that would block outward movement of the retainer pin would also be feasible.

The invention claimed is:

1. A lock assembly for engagement with a hasp having a hole therethrough, comprising:

a housing having an open back for placing the housing over the hasp;

a retainer pin extending through an aperture in the housing, the retainer pin having a retainer pin axis and being movable relative to the housing along the retainer pin axis for passing through the hole in the hasp to a locked position, the retainer pin having at least one shoulder thereon; and a key actuated lock member mounted to the housing, the lock member having a lock member axis perpendicular to the retainer pin axis and a lock pin extending from the lock member along the lock member axis, the lock pin being linearly movable along the lock member axis from a retracted position to an extended position into cooperative engagement with the retainer pin adjacent the shoulder in response to rotation of the lock member, to prevent removal of the retainer pin from the hasp while in the locked position.

2. The lock assembly according to claim 1, further comprising a bulkhead located within the housing and spaced from the aperture in the housing along the retainer pin axis, the bulkhead having a hole that is in alignment with the aperture along the retainer pin axis for receiving and supporting an end portion of the retainer pin, the bulkhead being recessed within the housing so that the end portion of the retainer pin is enclosed within the housing while in the locked position.

3. The lock assembly according to claim 1, wherein:

the housing has a pair of end walls connected by a pair of side walls;

each of the walls has an edge portion at the open back that is located within a common plane with the edge portions of the other walls; and a gasket is mounted to the edge portions of the end and side walls for contact with a door to which the hasp is mounted.

4. The lock assembly according to claim 1, wherein the housing has a front wall opposite the open back, and wherein the lock member is mounted to and accessible from the front wall.

5. The lock assembly according to claim 1, wherein:

the retainer pin has one end located exterior of the housing and one end within the interior of the housing while the lock assembly is in a locked position.

6. The lock assembly according to claim 1, wherein said at least one shoulder is defined by a section on the retainer pin that has a reduced cross-sectional dimension.

7. The lock assembly according to claim 1, wherein the retainer pin is cylindrical, and said at least one shoulder comprises two shoulders, each located in a plane normal to the retainer pin axis and facing each other, the shoulders having a reduced diameter cylindrical section between them.

8. The lock assembly according to claim 1, wherein the retainer pin has a greater length than the lock pin.

9. The lock assembly according to claim 1, wherein:

the housing has a front wall opposite the open back;

the front wall has a boss integrally formed therein and protruding in a forward direction from the front wall; and the lock member is mounted to the boss of the front wall.

10. The lock assembly according to claim 1, further comprising:

a gasket mounted to rearward edges of the housing at the open back for contact with a door on which the hasp is mounted.

11. A lock assembly for a hinged door, comprising:

a pair of hasps, one being pivotal relative to the other, each having a hole that aligns with the other while in an aligned position;

a pair of fasteners engaging the hasps for securing the hasps to a door;

a housing having a front wall, a pair of side walls, a pair of end walls, and the walls having free edges defining an open back for placing the housing over the hasps and against the door, the distance between the end walls being greater than a distance between the fasteners, such that the fasteners for the hasps are entirely enclosed by the housing when the housing is placed over the hasps;

a retainer pin extending through an aperture in one of the end walls and into engagement with a support hole formed in the housing, the retainer pin being movable relative to the housing along an axis of the pin for passing through the holes in the hasps while in the aligned position, the retainer pin having a shoulder thereon;

the retainer pin having a head located exterior of the housing and an end recessed within the housing while in engagement with the aperture and the support hole; and a key actuated lock member mounted to the housing, the lock member having a lock member axis with a lock pin extending from the lock member along the lock member axis perpendicular to the axis of the retainer pin, the lock pin being linearly movable along the lock member axis from a retracted position to an engaged position with an end portion located adjacent the shoulder of the retainer pin in response to rotation of the lock member to prevent removal of the retainer pin from the hasps while locked.

12. The lock assembly according to claim 11, wherein:

the hasps define a rectangular slot while in the aligned position for receiving and retaining a door handle; and the free edges of the side walls of the housing have recesses formed therein at the open back for fitting over the handle.

13. The lock assembly according to claim 11, further comprising:

a bulkhead formed in the housing between the end walls; and wherein the support hole for the pin is located in the bulkhead.

14. The lock assembly according to claim 11, wherein the lock is mounted to the front wall.

15. The lock assembly according to claim 11, wherein:

the retainer pin is cylindrical, and said at least one shoulder comprises two shoulders, each located in a plane normal to the axis of the retainer pin and facing each other, the shoulders having a reduced diameter cylindrical section between them.

16. The lock assembly according to claim 11, further comprising:

an elastomeric gasket mounted to the free edges of the end walls at the open back for placement of the housing against the door.

17. The lock assembly according to claim 11, further comprising:

a mounting plate having first and second ends; wherein the hasps are mounted to the mounting plate;

the fasteners extend through holes provided in the mounting plate; and a distance between the edges of the end walls is greater than a distance between the first and second ends of the mounting plate so that the mounting plate fits entirely within the housing.

18. A method of locking a door, the door having a pivotally mounted hasp with a hole therethrough that is alignable with a hole in a stationary hasp when the door is closed, each of the hasps being secured to the door by a fastener, the method comprising:

(a) providing a housing with first and second end walls joined by a pair of side walls, the end walls and side walls having free edges, defining an open back, the housing having a key actuated lock mounted thereto, the lock having a lock pin that is movable along an axis of the lock member between retracted and extended positions;

(b) placing the open back of the housing over the hasps while the holes in the hasps are aligned and pressing the free edges against the door such that heads of the fasteners are fully enclosed within the housing;

(c) inserting a retainer pin through an aperture in the first end wall of the housing and through the aligned holes of the hasps, the retainer pin being perpendicular to the axis of the lock member; then (d) rotating the lock and extending the lock pin from the retracted position to the extended position into locking engagement with the retainer pin to restrict movement of the retainer pin along an axis of the retainer pin.

* * * * *